US006368358B1

(12) United States Patent
Glenn et al.

(10) Patent No.: US 6,368,358 B1
(45) Date of Patent: Apr. 9, 2002

(54) USE OF DIBASIC ESTERS AS SOLVENTS FOR HYDROPHOBIC COMPOUNDS WHICH ACT AS SURFACE ACTIVE COMPONENTS ON TEXTILES

(75) Inventors: Susan C. Glenn; A. Howard Cole, both of Charlotte, NC (US); Kenneth L. Smith, Fort Mill, SC (US)

(73) Assignee: Cognis Corporation, Gulph Mills, PA (US)

( * ) Notice: Subject to any disclaimer, the term of this patent is extended or adjusted under 35 U.S.C. 154(b) by 0 days.

(21) Appl. No.: 09/645,692

(22) Filed: Aug. 25, 2000

Related U.S. Application Data

(60) Provisional application No. 60/156,247, filed on Sep. 27, 1999.

(51) Int. Cl.[7] ..... D06M 13/224; C11D 3/20
(52) U.S. Cl. ..... 8/115.6; 510/505
(58) Field of Search ..... 510/505; 8/115.6, 8/133

(56) References Cited

U.S. PATENT DOCUMENTS 5,712,237 A * 1/1998 Stevens ..... 510/291

* cited by examiner

*Primary Examiner*—John Hardee
(74) *Attorney, Agent, or Firm*—John E. Drach; Steven J. Trzaska

(57) ABSTRACT

A composition for use on synthetic textile substrates in order to inhibit autoxidation, the composition containing: (a) an antioxidant component; (b) a dibasic ester solvent; and (c) a surfactant component.

18 Claims, No Drawings

USE OF DIBASIC ESTERS AS SOLVENTS FOR HYDROPHOBIC COMPOUNDS WHICH ACT AS SURFACE ACTIVE COMPONENTS ON TEXTILES

CROSS-REFERENCE TO RELATED APPLICATIONS

This application claims the benefit of now abandoned provisional application serial number 60/156,247 filed on Sep. 27, 1999.

STATEMENT REGARDING FEDERALLY SPONSORED RESEARCH OR DEVELOPMENT

NOT APPLICABLE.

BACKGROUND OF THE INVENTION

In the conventional production of textile fibers and fabrics made from synthetic polymers, it is customary to add certain chemicals to the polymer for various reasons. These additives include pigments for color, antioxidants, ultraviolet screening compounds, delusterants, antistatic agents, whiteners, and the like.

Antioxidants are typically added to synthetic textile fibers and fabrics in order to inhibit yellowing thereof caused by the oxidation of the polymer with the various compounds present in the atmosphere. For example, it is known from the art to add various phenyl phosphinate salts and combinations thereof to nylon polymers in order to inhibit yellowing of the resultant nylon yarns.

The treatment of polymeric fibers and fabrics with conventional hydrophobic additives such as those listed above requires that said additives first be emulsified in a solvent, prior to their application onto the polymeric textile substrate. Once the hydrophobic additives are effectively emulsified in the solvent, the resultant composition may then be applied, along with any other auxiliaries such as surfactants and the like, onto the polymeric textile substrate. Upon application thereon, the polymeric textile substrate, such as nylon fabric, is then either air-dried or heat-treated in order to effectively adhere the additive onto the substrate.

A problem associated with the application of these types hydrophobic additives onto the polymeric textile substrate relates to the solvents used to emulsify the additive. Conventional organic solvents such as n, methyl pyrollidone are toxic and non-biodegradable. Consequently, their use poses a threat to the environment.

BRIEF SUMMARY OF THE INVENTION

The present invention is directed to a composition for use on synthetic textile substrates in order to inhibit color degradation caused by oxidation, the composition containing:

(a) an antioxidant component;

(b) a dibasic ester solvent;

(c) a surfactant component; and (d) optionally, water.

The present invention is also directed to a process for inhibiting the autoxidation of synthetic textile substrates, the process involving:

(a) providing a composition containing:

(i) an antioxidant component;

(ii) a dibasic ester solvent;

(iii) a surfactant; and (iv) optionally, water; and (b) applying the composition onto the synthetic textile substrate.

BRIEF DESCRIPTION OF THE SEVERAL VIEWS OF THE DRAWING

NOT APPLICABLE.

DETAILED DESCRIPTION OF THE INVENTION

Other than in the operating examples, or where otherwise indicated, all numbers expressing quantities of ingredients and/or reaction conditions are to be understood as being modified in all instances by the term "about".

The term "synthetic textile substrate" as defined herein, relates to a polymeric textile fiber or fabric either by itself or blended with a natural fiber or fabric such as, for example, cotton.

The present invention is based on the surprising discovery that an antioxidant used for the purpose of inhibiting the yellowing, i.e., color degradation, of synthetic fibers/fabrics, can be effectively emulsified in a dibasic ester solvent which is both non-toxic and biodegradable, as compared to conventional organic solvents.

Antioxidants are substances that retard oxidation by atmospheric oxygen. Autoxidation is a free-radical chain reaction and, therefore, can be inhibited at the initiation and propagation steps. Autoxidation often has a long kinetic chain length. Therefore, agents that interrupt the propagation step markedly reduce the oxidation rate. Suitable antioxidants for use in the present invention include, in general, amines, phenols, phosphites, sulfides and metal salts of dithioacids. Hindered phenols and secondary alkylaryl- and diarylamines, due to their commercial availability, are preferred propagation inhibitors. A particularly preferred antioxidant is a dibenzylhydroxylamine. It should be noted, however, that any antioxidant component capable of inhibiting the autoxidation and related yellowing effect of a synthetic textile substrate may be used, without departing from the spirit of the invention.

Dibasic esters are generally defined as dialkyl esters of dicarboxylic acids capable of undergoing reactions at the ester group, including both hydrolysis and saponification. The acid portion of the dibasic ester may be derived from such dibasic acids as oxalic, malonic, pimelic, suberic and azelaic acids, as well as mixtures thereof.

Examples of suitable dibasic esters for use in the present invention include, but are not limited to, dimethyladipate, dimethyl glutarate, dimethyl succinate, and mixtures thereof. Dibasic esters are commercially available from companies such as E. I. duPont de Nemours & Co., Inc., Wilmington, Del. under the tradenames DBE, DBE-2, DBE-3, DBE-4, DBE-5, DBE-6 and DBE-9, and Monsanto Company, St. Louis, Mo. under the tradenames SANTOSOL® DME, DME-2, DME-3, DMG, DMA and DMS. A particularly preferred dibasic ester is a mixture of dimethyl adipate, dimethyl glutarate, and dimethyl succinate in varying weight ratios.

The surfactant component aids in both emulsifying the dibasic ester plus antioxidant emulsion and facilitates the enhanced uptake of the composition onto the surface of the synthetic textile substrate. Suitable surfactants which may be employed include, but are not limited to, nonionics, anionics, cationics, amphoterics and zwitterionics.

Suitable nonionic surfactants include, but are not limited to, polyethylene, polypropylene, and polybutylene oxide condensates of alkyl phenols. In general, the polyethylene oxide condensates are preferred. These compounds include the condensation products of alkyl phenols having an alkyl group containing from about 6 to about 12 carbon atoms in either a straight chain or branched chain configuration with the alkylene oxide. In a preferred embodiment, the ethylene oxide is present in an amount equal to from about 5 to about 25 moles of ethylene oxide per mole of alkyl phenol. Commercially available nonionic surfactants of this type include IGEPAL® CO-630, marketed by the GAF Corporation; and TRITON® X-45, X-114, X-100, and X-102, all marketed by the Rohm & Haas Company. This category includes, for example, alkyl phenol alkoxylates such as the alkylphenol ethoxylates.

The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 2 to about 18 moles of ethylene oxide per mole of alcohol. Examples of commercially available nonionic surfactants of this type include TERGITOL® 15-S-9 (the condensation product of $C_{11}$–$C_{15}$ linear secondary alcohol with 9 moles ethylene oxide), TERGITOL® 24-L-6 NMW (the condensation product of $C_{12}$–$C_{14}$ primary alcohol with 6 moles ethylene oxide with a narrow molecular weight distribution), both marketed by Union Carbide Corporation; NEODOL® 45-9 (the condensation product of $C_{14}$–$C_{15}$ linear alcohol with 9 moles of ethylene oxide), NEODOL® 23-6.5 (the condensation product of $C_{12}$–$C_{13}$ linear alcohol with 6.5 moles of ethylene oxide), NEODOL® 45-7 (the condensation product of $C_{14}$–$C_{15}$ linear alcohol with 7 moles of ethylene oxide), NEODOL® 45-4 (the condensation product of $C_{14}$–$C_{15}$ linear alcohol with 4 moles of ethylene oxide), marketed by Shell Chemical Company, and KYRO® EOB (the condensation product of $C_{13}$–$C_{15}$ alcohol with 9 moles ethylene oxide), marketed by The Proctor & Gamble Company. These surfactants are commonly referred to as alkyl ethoxylates.

The condensation products of ethylene oxide with a hydrophobic base formed by the condensation of propylene oxide with propylene glycol. The hydrophobic portion of these compounds preferably has a molecular weight of from about 1500 to about 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available PLURONIC® surfactants, marketed by BASF.

The condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available TETRONIC® compounds, marketed by BASF.

Semi-polar nonionic surfactants are a special category of nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Semi-polar nonionic surfactants include the amine oxide surfactants having the formula:

$$R^3(OR^4)_xN(O)(R^5)_2$$

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxy ethyl amine oxides.

Anionic surfactants can be selected from the group consisting of sulfates, sulfonates, carboxylates and mixtures thereof. The surfactants are neutralized with a cationic moiety or moieties selected from the group consisting of alkali metal, e.g. sodium or potassium, alkaline earth metal, e.g. calcium or magnesium, ammonium, substituted ammonium, including mono-, di-, or tri-, ethanolammonium cations. Mixtures of cations can be desirable. The anionic surfactants which may be useful in the present invention all have detergent properties and are all water soluble or dispersible in water.

One class of surfactants which may be used in this invention are the alkylbenzene sulfonates. The alkyl group can be either saturated or unsaturated, branched or straight chain and is optionally substituted with a hydroxy group. Middle phenyl positions are generally preferred for volume of foaming in light soil conditions. However, in heavier soil conditions phenyl attachment at the 1- or 2-position is preferred.

The preferred alkylbenzene sulfonates contain a straight alkyl chain containing from about 9 to about 25 carbon atoms, preferably from about 10 to about 13 carbon atoms, and the cation is sodium, potassium, ammonium, mono-, di-, or triethanolammonium, calcium or magnesium and mixtures thereof. Magnesium is the preferred cationic moiety. These same cations are preferred for other anionic surfactants and ingredients. The magnesium alkylbenzene sulfonates where the phenyl group is attached near the middle of the alkyl chain are surprisingly better than the ones with the phenyl near the end of the chain when the polysaccharide chain averages greater than about 3 saccharide units. Suitable alkylbenzene sulfonates include $C_{11}$ alkylbenzene sulfonates with low 2-phenyl content.

Other surfactants which may be used in this invention are carboxylates, e.g. fatty acid soaps and similar surfactants.

The soaps can be saturated or unsaturated and can contain various substituents such as hydroxy groups and alpha-sulfonate groups. Preferably, the hydrophobic portion of the soap is a straight chain saturated or unsaturated hydrocarbon. The hydrophobic portion of the soap usually contains from about 6 to about 30 carbon atoms, preferably from about 10 to about 18 carbon atoms.

The cationic moiety (M) for carboxylate surfactants is selected from the group consisting of alkali metal, for example, sodium or potassium, alkaline earth metal, for example, calcium or magnesium, ammonium, or substituted ammonium, including mono-, di-, or triethanolammonium cations. Mixtures of cations can be desirable.

Yet other surfactants are the alkyl (paraffin or olefin) sulfonates, preferably with a more central hydrophilic group, containing from about 6 to about 30 carbon atoms. Examples include $C_{14-15}$ paraffin sulfonates and $C_{14-16}$ olefin sulfonates.

Another group of surfactants that may be of interest are the zwitterionic surfactants which contain both a cationic group, either ammonium, phosphonium, sulfonium or mixtures thereof and a sulfonate or carboxylate group. Preferably there are at least about four atoms separating the cationic and anionic groups.

Yet another group of surfactants are the amphoteric surfactants which have the same general structure as the zwitterionic surfactants but with an amine group instead of the quaternary ammonium group.

Cationic surfactants may also be included in the compositions of the present invention. Cationic surfactants include the ammonium surfactants such as alkyldimethyl ammonium halogenides, and those surfactants having the formula:

$$[R^2(OR^3)_y][R^4(OR^3)_y]_2R^5N^{\oplus}X^{\ominus}$$

wherein $R^2$ is an alkyl or alkyl benzyl group having from about 8 to about 18 carbon atoms in the alkyl chain, each $R^3$ is selected from the group consisting of $—CH_2CH_2—$, $—CH_2CH(CH_3)—$, $—CH_2CH(CH_2OH)—$, $—CH_2CH_2CH_2—$, and mixtures thereof; each $R^4$ is selected from the group consisting of $C_1$–$C_4$ alkyl, $C_1$–C4 hydroxyalkyl, benzyl, ring structures formed by joining the two $R^4$ groups, $—CH_2CHOHCHOHCOR^6$ $—CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Particularly preferred surfactants for use in the composition of the present invention are those having an HLB value of from about 5 to about 17, preferably about 9 to about 15, and most preferably from about 12 to about 14.

According to one embodiment of the present invention, there is provided a composition for use on synthetic textile substrates in order to inhibit their color degradation and yellowing caused by atmospheric autoxidation, the composition containing: (a) from about 0.5 to about 5.0% by weight, preferably from about 1.0 to about 4.0% by weight, and most preferably from about 1.5 to about 3.5% by weight, of an antioxidant; (b) from about 15.0 to about 30% by weight, preferably from about 18.0 to about 27.0% by weight, and most preferably from about 20.0 to about 25.0% by weight, of a dibasic ester solvent; and (c) from about 65.0 to about 85.0% by weight, preferably from about 69.0 to about 81.0% by weight, and most preferably from about 71.0 to about 78.5% by weight, of a surfactant component, all weights being based on the weight of the composition.

The composition of the present invention can be applied onto the surface of a synthetic textile substrate using any conventional means know in the art. Once the composition is applied onto the substrate, it undergoes heat treatment so that the composition effectively adheres itself onto the substrate.

Thus, according to yet another embodiment of the present invention, there is also provided a process for inhibiting the autoxidation of synthetic textile substrates, the process involving: (a) providing a composition containing: (i) from about 0.5 to about 5.0% by weight, preferably from about 1.0 to about 4.0% by weight, and most preferably from about 1.5 to about 3.5% by weight, of an antioxidant component; (ii) from about 15.0 to about 30.0% by weight, preferably from about 18.0 to about 27.0% by weight, and most preferably from about 20.0 to about 25.0% by weight, of a dibasic ester solvent; and (iii) from about 65.0 to about 85.0% by weight, preferably from about 69.0 to about 81.0% by weight, and most preferably from about 71.0 to about 78.5% by weight, of a surfactant; and (b) applying the composition onto the synthetic textile substrate.

The composition may be applied onto the substrate either directly in the form of a neat solution, or, it may first be introduced into an aqueous bath and then subsequently applied onto the substrate. The form in which it is applied will depend on the type of equipment owned by the user.

Once the composition is applied onto the substrate, it is then either air-dried or heat-treated at a temperature of from about 20 to about 100° C. In the event that it is heat-treated, any conventional heat-treating apparatus may be utilized.

The present invention will be better understood from the examples which follow, all of which are intended for illustrative purposes only and are not meant to unduly limit the scope of the invention in any way.

EXAMPLES

Nylonlelastomeric fabric swatches were treated with various compositions in order to determine their whiteness levels using ASTM Whiteness E313. Their composition and results are found in Table 1, below.

TABLE 1

| Example | Air-dried | 350° F., 30 sec. | 370° F., 30 sec. | 390° F., 30 sec. | 370° F., 60 sec. | 30 hours in Nitrous Oxide |
|---|---|---|---|---|---|---|
| SYNTERGENT SF | 73.71 | 58.77 | 52.40 | 54.62 | 47.40 | 64.03 |
| SYNTERGENT SFN | 73.18 | 60.55 | 53.64 | 45.72 | 40.06 | 63.27 |
| SYNTERGENT SFE | 74.52 | 61.48 | 53.82 | 52.89 | 41.44 | 67.03 |

TABLE 1-continued

| Example | Air-dried | 350° F., 30 sec. | 370° F., 30 sec. | 390° F., 30 sec. | 370° F., 60 sec. | 30 hours in Nitrous Oxide |
|---|---|---|---|---|---|---|

SYNTERGENT ®SFE = a mixture of dibenzlyhydroxylamine + DBE + tridecylalcohol having 9 moles of EO.
SYNTERGENT ®SFN = a mixture of dibenzylhydroxylamine + nonylphenol having 9 moles of EO.
SYNTERGENT ®SF = a mixture of dibenzylhydroxylamine + N-methyl pyrrolidone + nonylphenol having 9 moles of EO.

It is clearly seen from the data that the use of a non-toxic dibasic ester as a solvent, as opposed to a toxic organic solvent, results in no loss of performance.

What is claimed is:

1. A composition comprising:

(a) an antioxdant component;

(b) a dibasic ester solvent;

(c) from about 65 to about 85% by weight, based on the weight of the composition, of a surfactant component; and (d) optionally, water.

2. The composition of claim 1 wherein the antioxidant component is present in the composition in an amount of from about 0.5 to about 5.0% by weight, based on the weight of the composition.

3. The composition of claim 1 wherein the antioxidant is dibenzylhydroxylamine.

4. The composition of claim 1 wherein the dibasic ester solvent is present in the composition in an amount of from about 15.0 to about 30.0% by weight, based on the weight of the composition.

5. The composition of claim 1 wherein the dibasic ester is a mixture of dimethyl adipate, dimethyl glutarate and dimethyl succinate.

6. The composition of claim 1 wherein the surfactant is a nonionic surfactant.

7. The composition of claim 6 wherein the nonionic surfactant is selected from the group consisting of ethoxylated nonylphenol, ethoxylated tridecyl alcohol, and mixtures thereof.

8. A composition comprising:

(a) from about 1.5 to about 3.5% by weight of a dibenzylhydroxylamine;

(b) from about 20.0 to about 25.0% by weight of a mixture of dimethyl adipate, dimethyl glutarate and dimethyl succinate;

(c) from about 71.0 to about 78.5% by weight of a surfactant selected from the group consisting of ethoxylated nonylphenol, ethoxylated tridecyl alcohol, and mixtures thereof; and (d) optionally, water, all weights being based on the weight of the composition.

9. A process for inhibiting the autoxidation of synthetic textile substrates comprising:

(a) providing a composition containing:

(i) an antioxidant component;

(ii) a dibasic ester solvent; and (iii) a surfactant; and (b) adhering the composition onto the synthetic textile substrate to form a treated synthetic textile substrate.

10. The process of claim 9 wherein the antioxidant component is present in the composition in an amount of from about 0.5 to about 5.0% by weight, based on the weight of the composition.

11. The process of claim 9 wherein the antioxidant is dibenzylhydroxylamine.

12. The process of claim 9 wherein the dibasic ester solvent is present in the composition in an amount of from about 15.0 to about 30% by weight, based on the weight of the composition.

13. The process of claim 9 wherein the dibasic ester is a mixture of dimethyl adipate, dimethyl glutarate and dimethyl succinate.

14. The process of claim 9 wherein the surfactant is present in the composition in an amount of from about 65.0 to about 85.0% by weight, based on the weight of the composition.

15. The process of claim 9 wherein the surfactant is a nonionic surfactant.

16. The process of claim 15 wherein the nonionic surfactant is selected from the group consisting of ethoxylated nonylphenol, ethoxylated tridecyl alcohol, and mixtures thereof.

17. The process of claim 9 further comprising heating the treated synthetic textile substrate in order to adhere the composition onto the substrate.

18. The process of claim 9 wherein the composition is first introduced into an aqueous bath and then applied onto the synthetic textile substrate.

* * * * *